United States Patent [19]

Campbell et al.

[11] Patent Number: 5,055,822

[45] Date of Patent: Oct. 8, 1991

[54] SCENT ALARM DEVICE

[76] Inventors: Gordon Campbell, 128 Albany Rd., Oak Ridge, Tenn. 37830; Dewey Feezell, Box 408-A, Rte. 5, Athens, Tenn. 37303

[21] Appl. No.: 549,353

[22] Filed: Jul. 6, 1990

[51] Int. Cl.[5] ..... G08R 1/00

[52] U.S. Cl. ..... 340/407; 340/628; 116/214; 222/644; 222/648

[58] Field of Search ..... 340/407, 628; 116/214; 222/645, 646, 647, 648, 644; 368/12

[56] References Cited

U.S. PATENT DOCUMENTS

| | | | |
|---|---|---|---|
| 2,468,369 | 4/1949 | Jones | 116/214 |
| 2,894,478 | 7/1959 | Reed et al. | 116/214 |
| 3,430,219 | 2/1969 | Powers | 340/590 |
| 3,615,041 | 10/1971 | Bischoff | 222/648 |
| 3,861,350 | 1/1975 | Selleck | 116/214 X |
| 4,404,923 | 9/1983 | Smith | 116/214 |
| 4,407,585 | 10/1983 | Hartford et al. | 368/12 |
| 4,573,804 | 3/1986 | Kavoussi et al. | 368/12 |
| 4,698,620 | 10/1987 | Marshall | 340/568 |

FOREIGN PATENT DOCUMENTS

| | | | |
|---|---|---|---|
| 1426583 | 3/1976 | United Kingdom | 222/648 |

*Primary Examiner*—Donnie L. Crosland
*Assistant Examiner*—Jeffery A. Hofsass
*Attorney, Agent, or Firm*—Luedeka, Hodges, Neely, & Graham

[57] ABSTRACT

A scent alarm device which includes a housing and a spray canister of an odorant, such as butyl mercaptan, supported within the housing utilizes a mechanism for intermittently dispensing odorant from the canister upon the occurrence of a predetermined event. The spray canister has a depressible release valve for releasing canister contents upon depression of the valve, and the depressing mechanism is adapted to repeatedly depress the canister release valve in an intermittent fashion. The device may utilize a canister having a height within a range of canister heights, and if desired, the device may be interfaced with a number of other alarm systems, such as a smoke or heat detector or used to alert an individual that household electrical power has been shut off.

9 Claims, 3 Drawing Sheets

SCENT ALARM DEVICE

BACKGROUND AND SUMMARY OF THE INVENTION

This invention relates generally to warning devices and relates, more particularly, to warning devices for emitting an alarm in the form of an odorant.

There exists scent alarm devices for emitting an odorant, such as butyl mercaptan, into breathable air upon the occurrence of a predetermined event. Two such devices which are shown and described in U.S. Pat. Nos. 2,468,369 and 2,894,478 are concerned with stench warning systems utilizing a canister of stench which, when punctured by manually-actuated means, release the contents of the canister into the ventilation or compressed air system of a mine shaft. Another scent alarm device, shown and described in U.S. Pat. No. 4,404,923, utilizes a container of odoriferous fluid which is adapted to break and release its contents upon the exposure to excessive heat, such as may be generated in a fire.

A limitation associated with scent alarm devices such as those of the referenced patents relates to the inability to reuse the devices described therein without replenishing the supply of scent within the system. When, for example, the canister or container of stench is punctured or broken, all of the canister contents are released so that a new canister or container of stench must be installed within the system before the system can be reused.

Accordingly, it is an object of the present invention to provide a new and improved scent alarm device which may be reused many times without the need for re-installing a new odorant-filled canister or container after each use.

Another object of the present invention is to provide such a device which is adapted to utilize a spray canister containing an odorant.

Yet another object of the present invention is to provide such a device wherein the spray canister utilized therewith may possess a height within a broad range of heights.

Still another object of the present invention is to provide such a device which may be readily interfaced with a fire, smoke, heat or other alarm system for actuation of the device when the other system is actuated.

Yet still another object of the present invention is to provide such a device which is particularly well-suited for use in a residence by individuals who are blind, deaf, or hard of hearing.

This invention resides in a scent alarm device comprising a spray canister of an odorant having a depressible release valve for release of canister contents upon the depression of the release valve and means for intermittently depressing the release valve upon the occurrence of a predetermined event so that canister contents are released into the surrounding atmosphere in an intermittent fashion.

BRIEF DESCRIPTION OF THE DRAWINGS

FIG. 2 is a view similar to that of FIG. 1 of the FIG. 1 device wherein the front access door of the device is shown in an opened position.

DETAILED DESCRIPTION OF THE ILLUSTRATED EMBODIMENTS

Figure 1:
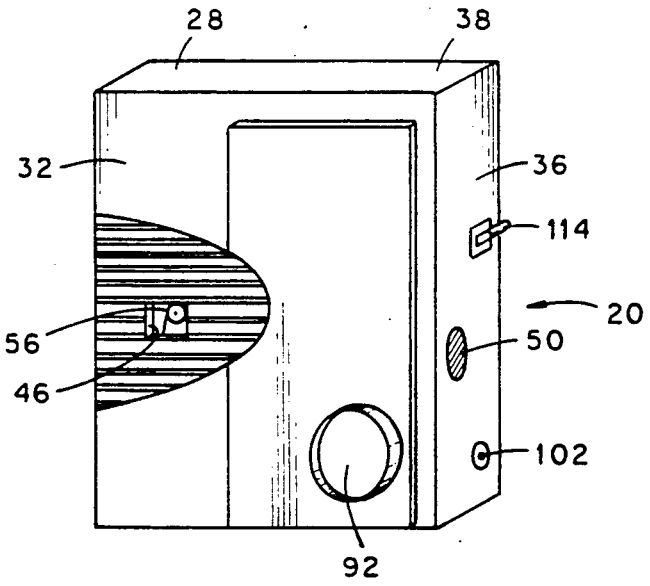
FIG. 1 is a perspective view of an embodiment of a scent alarm device embodying various features of the present invention.
Figure 1:
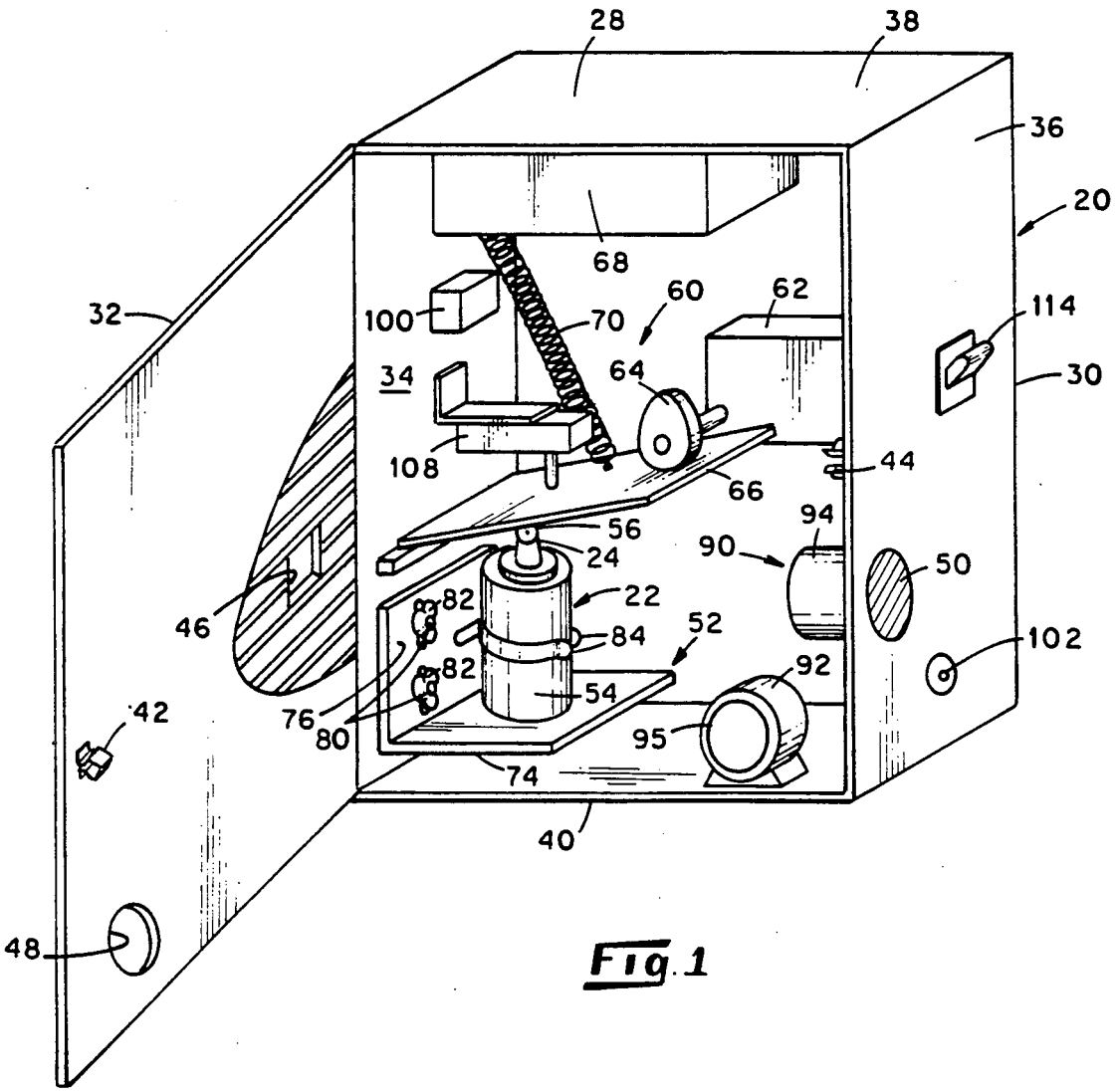

Turning now to the drawings in greater detail, there is illustrated in FIGS. 1 and 2 a scent alarm device, indicated 20, within which features of the present invention are embodied. The device 20 includes a spray canister 22 of an odorant, such as butyl mercaptan, having a depressible release valve 24 for releasing contents of the canister 22 upon the occurrence of a predetermined event. As will be apparent herein, the spray canister 22 may be in the form of a canister containing contents under pressure or a pump-type canister whose contents are dispensed from the valve 24 by repeatedly moving the valve 24 between depressed and extended positions.

The device 20 may be used in any of a number of applications to alert or warn an individual of the occurrence of a predetermined event. The device 20 may, for example, be interfaced with a smoke or heat detector to warn or alert an individual that the smoke or heat detector has been activated, with appropriate temperature sensors for indicating that a room has reached a temperature level which is either too cold or too hot, with an appropriate electrical sensor for indicating that household electrical power has been shut off, or with a burglar alarm for indicating that the burglar alarm has been activated. The depicted device 20 is adapted to be energized upon the energizing of an electrical circuit with which the device 20 is interfaced, but it is to be understood that the principles of the invention can be variously applied.

The device 20 includes a housing 28 having a back 30, a front 32, two opposite sides 34, 36, a top 38 and a bottom 40. The front 32 is hingedly connected to an edge of the side 34 for movement between a closed position as illustrated in FIG. 1 and an open position as illustrated in FIG. 2. A tab member 42 is affixed to the front 32 in the manner illustrated in FIG. 2 and cooperates with a corresponding fastener member 44 affixed to the housing side 36 for releasably securing the front 32 in its FIG. 1 closed position.

The front 32 also includes a vent passage 46 which, when the front 32 is in a closed position, permits communication between the interior and the exterior of the housing 28. As will be apparent herein, the vent passage 46 permits odorous contents released from the canister 22 to escape into the atmosphere surrounding the housing 28. The front 32 also includes an opening 48 and the side 36 includes an opening 50 for providing passages through which audible sounds and light generated within the housing 28 in a manner hereinafter described are emitted from the housing interior.

The device 20 also includes means, indicated 52, for supporting the canister 22 in an upright condition within the housing interior. The canister 22 includes a cylindrical container 54 having a depressible release valve 24, mentioned earlier, mounted in the top thereof. The container 54 is similar in construction to spray cans commonly used to dispense paints, insect sprays or hair spray. The contents of the canister 22 which are released upon depression of the valve 24 escape in an atomized condition through a spray nozzle 56 associated with the valve 24. In the depicted device 20, the nozzle 56 opens at generally a right angle to the longitudinal, i.e. vertical, axis of the cylindrical container 54, and the support means 52 supports the canister 22 adjacent the vent passage 46 of the housing front 32 so that when the valve nozzle 56 is depressed, the canister contents are directed generally through the passage 46 and into the surrounding atmosphere. Once the forces exerted upon the canister 22 for depressing the nozzle 56 to its depressed position are relieved, the nozzle 56 returns to its extended position by means of either the internal pressure of the canister contents or a compression spring associated with the release valve 24.

The device 20 also includes means, indicated 60, for intermittently depressing the valve nozzle 56 upon the occurrence of a predetermined event so that the odorant contents of the canister 22 are released from the housing 28 in an intermittent fashion. The depressing means 60 includes an electric servomotor 62, a cam 64 attached to the shaft of the motor 62 for rotation therewith, an elevated platform 66 hingedly connected to the housing side 34, and an electric power source in the form of a battery 68. The platform 66 is elongate and platen-like in form and arranged so as to overlie the top of the valve nozzle 56 intermediate of the platform ends as illustrated in solid lines in FIG. 3. The hinged connection between one of the platform ends and the housing side 34 permits the platform 66 to be hingedly moved between a raised position as illustrated in solid line in FIG. 3 and a lowered position as illustrated in phantom in FIG. 3. When the platform end opposite the hinged end is pressed downwardly to the FIG. 3 lowered position, the platform 66 acts as a lever member to move the valve nozzle 56 downwardly to release the canister contents.

For operation of the device 20 in the intended manner, the elevated platform 66 is biased from its lowered position to its raised position so that the nozzle 56 is permitted to return to its extended position once forces exerted upon the canister 22 to depress the nozzle 56 are relieved. In the device 20, the platform 66 is biased to its FIG. 3 raised position by the upward urging of the platform 66 by the nozzle 56 as the nozzle 56 seeks to return to its extended position. If desired, however, a tension spring 70 may be connected between an end of the platform 66 and the housing top 38 to ensure that the platform 66 returns to its raised position following depression of the valve nozzle 56 in the manner described herein.

Figure 3:
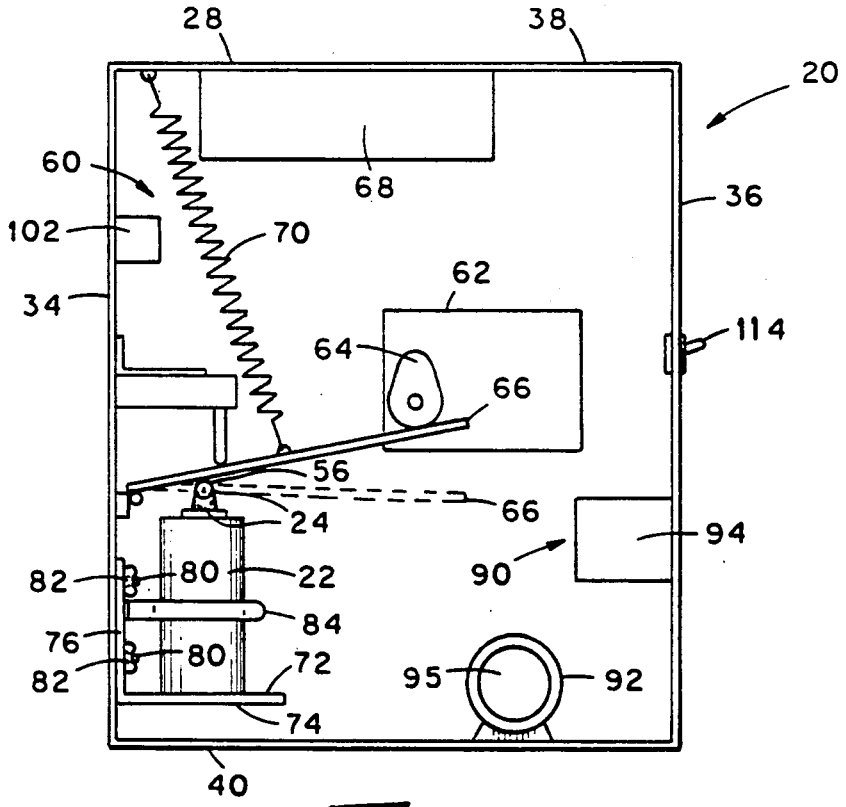
FIG. 3 is a front elevational view of the FIG. 1 device as seen through its front, when opened.

The motor 62 is appropriately mounted within the housing 28 so that the cam 64 engages the upper side of the platform 66 as illustrated in FIG. 3. The cam 64 possesses such a size and shape so that rotation of the cam 64 by the motor shaft effects an upward and downward shifting of the platform 66 between its raised and lowered positions. More specifically, the cam 64 pushes the platform 66 downwardly to its lowered position and permits the platform 66 to return to its raised position in an alternating fashion so that the nozzle 56 is reciprocated by the platform 66 between depressed and extended conditions.

Because the release valve nozzle 56 is intermittently depressed by the depressing means 60 during the rotation of the cam 64, the contents of the canister 22 are released in an intermittent fashion. Such an intermittent release of contents is preferred over a continual release of contents for the sake of conserving canister contents for reuse of the device 20 at a later time. In addition and as is explained in greater detail herein, the cam 64 is prevented from stopping at a rotational position which holds the valve nozzle 56 in a depressed condition so that the canister contents cannot be completely discharged by de-energizing the motor 62. Various odorants are known to disperse within the atmosphere within a relatively short period of time, and butyl mercaptan, for example, may be sensed with the nose if only one molecule is present in sixty billion molecules of air. Thus, the intermittent depressing of the nozzle 56 conserves the canister contents at no appreciable expense of the warning capabilities of the device 20. In addition, the intermittent depressing of the nozzle 56 by the depressing means 60 enables a non-aerosol canister to be used in the device 20. The release valve of such a canister operates in a manner similar to the spray nozzles commonly associated with window cleaner containers and non-aerosol hair spray containers which require that the release valve nozzle thereof be "pumped" between depressed and extended conditions for releasing contents from the container.

It is another feature of the device 20 that spray canisters having different heights can be mounted within the housing 28 for use with the device 20. To this end, the support means 52 includes a support platform 72 having a bottom 74 whose distance from the elevated platform 66 can be adjusted. In this connection, the support platform 72 includes a side member 76 having vertically-oriented slots 78, and there extends through the housing sides 34 and the slots 78 a pair of externally-threaded studs 80. Wing nuts 82 are threadably positioned about the studs 80 so that by loosening the wing nuts 82, the support platform 72 may be shifted vertically along the housing side 34 as the slots move along the studs 80. Conversely, by tightening the wing nuts 82 upon the studs 80, the platform 72 is secured in position between the housing side 34 and the wing nuts 82.

To enhance the securement of a canister 22 upon the platform 72, the device 20 includes a pair of resilient fingers 84 attached to the platform side member 76 and appropriately spaced from one another for tightly encircling the canister container 54 when the container 54 is positioned upon the platform 72. As the canister 22 is urged into position between the fingers 84, the fingers 84 flex outwardly to accommodate the movement of the canister 22 therebetween and move into a snap-fit relationship about the lower portion of the canister container 54 once the canister 22 has been positioned in its proper position upon the platform bottom 74.

To install the canister 22 within the housing 28, the support platform 72 is lowered to a position accommodating the positioning of the canister upon the platform bottom 74 with no interference from the elevated platform 66. The canister 22 is then placed upon the platform bottom 74 and between the resilient finger members 84. The platform bottom 84 is then adjusted in position, i.e., raised along the housing side 34, until the canister nozzle 56 contacts the underside of the elevated platform 66. The wing nuts 82 are then tightened to secure the support platform 72 and canister 22 in position beneath the elevated platform 66 so that subsequent raising and lowering of the elevated platform 66 effects a reciprocating of the nozzle 56 between depressed and extended conditions. It follows that the capacity to vertically adjust the position of the platform 72 along the housing side 34 permits the device 20 to utilize odorant canisters having a height within a broad range of heights.

The device 20 also includes means, generally indicated 90, for generating an audible alarm and a light 92 for illuminating an area adjacent the device 20 upon the occurrence of a predetermined event. The sound-generating means 90 is in the form of a sound device 94 adapted to emit an audible sound upon the passage of electrical current therethrough, and the light 92 includes a standard incandescent bulb 95 which is also energized upon the passage of electrical current therethrough. The sound device 94 and the light 92 are suitably mounted within the housing 28 so that when the housing front 32 is in a closed position, the sound device 94 and light 92 are positioned adjacent the corresponding opening 50 or 48 provided in the front 32 and side 36, respectively, so that sound emitted by the sound device 94 exits the housing 28 through the side opening 50 and so that light emitted by the bulb 95 exits the housing 28 through the front opening 48.

Power for each of the motor 62, light 92 and sound device 94 is provided by the battery 68, mentioned earlier, and an input relay 100 is appropriately wired within the circuit of the device 20 for energizing the motor 62, light 92 and sound device 94 upon the closing of the relay 100.

Figure 4:
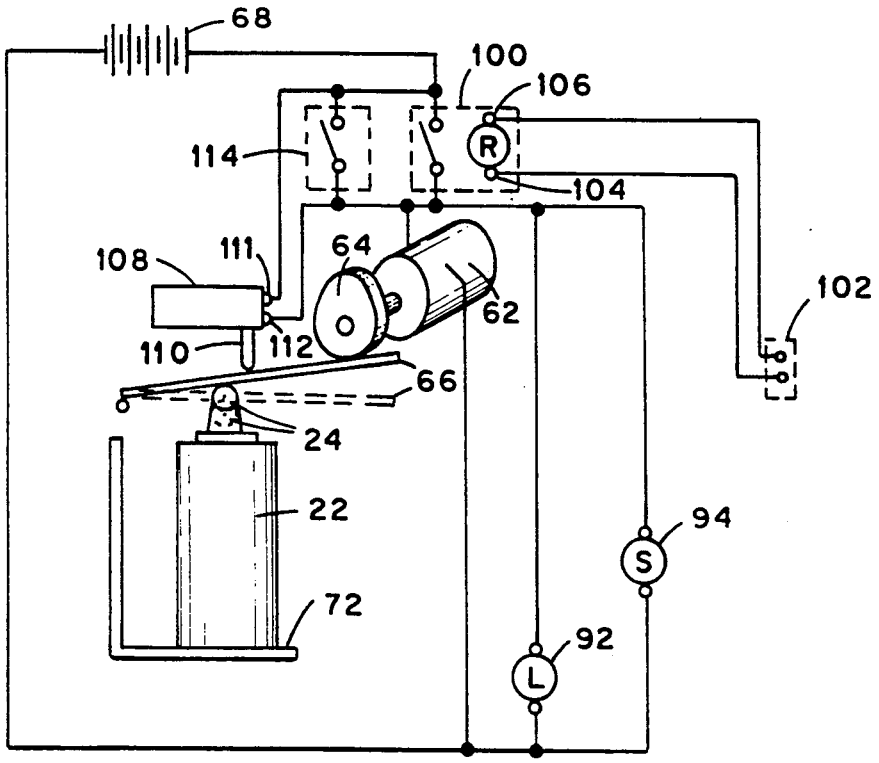
FIG. 4 is a wiring schematic of the FIG. 1 device.

The relay 100 of the depicted device 20 is normally-open and permits the device 20 to be interfaced with an auxiliary unit (not shown), such as a smoke or heat detector, so that the device 20 is activated the moment that the auxiliary unit is energized. Accordingly, the auxiliary unit is appropriately wired to the relay 100 through an input plug 102 provided in the housing side 36 so that the relay 100 closes upon the sensing of a predetermined voltage across relay contacts 104 and 106 (FIG. 4).

To prevent the device 20, and more particularly, the motor 62 from shutting off while the release valve nozzle 56 is maintained in a depressed position, a limit switch 108 having a plunger-type actuator 110 is mounted within the housing 28 so that its actuator 110 is in contact with the upper side of the elevated platform 66 and moves therewith between raised and lowered positions. The limit switch 108 has contacts 111, 112 which are open only when the actuator 110 is in a raised condition (corresponding to the raised position of the platform 66). Therefore, as the elevated platform 66 repeatedly moves between its raised and lowered position by means of the motor 62 and cam 64, the switch actuator 110 is repeatedly moved between raised and lowered positions to close and open the contacts 111, 112 of the limit switch 108. It follows that unless the nozzle 56 is in an extended condition at the moment that the relay 100 opens to deactivate the device 20, the motor 62 continues to be energized until the elevated platform 66 returns to its raised position.

An advantage provided by the device 20 relates to the emission of both an odorant from the canister 22 and the emission of an audible sound from the sound device 92 upon activation of the device 20. The odorant, of course, permeates the air so that individuals who are relatively far from the device 20 may smell the odor and react accordingly. Because the odorant is sensed by the nose, the device 20 is particularly well-suited for use by individuals who are blind or partially or totally deaf. In addition, because the sense of smell of a sleeping individual is known to remain alert even though the sense of hearing is normally diminished in power, the odorant emitted from the device 20 may awaken or alert an individual before the sound emitted from the sound device 92 alerts the individual. In any event, the emission of both an odorant and audible sounds from the device 20 provides signals capable of being sensed by an individual's sense of smell and sense of hearing.

The light 92 is advantageous in that it illuminates the area within which the device 20 is mounted when the device 20 is activated. The illumination of such an area may be important if the appropriate reaction of an individual alerted by the device depends upon his being able to see where he is going. Moreover, the light emitted by the light 94 may be particularly important if the device 20 is mounted within a dark area or electrical power routed to other lights in the household is shut off.

With reference to FIG. 4, the device 20 also includes a test switch 114 mounted in the housing side 36 so as to be accessible from outside the housing 28. The switch 114 is appropriately wired in the circuit of the device 20 so that electrical power is supplied to each of the motor 62, light 92 and sound device 94 upon appropriate actuation of the switch 114. The test switch 114 thus enables an individual to periodically check the operability of the various components of the device 20.

Figure 5:
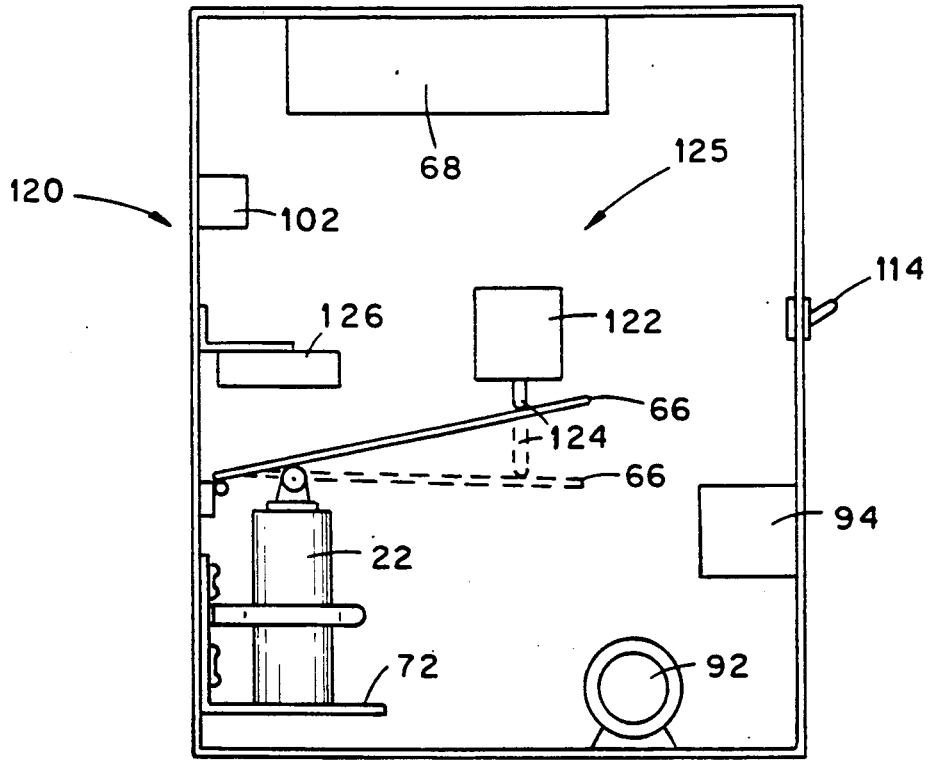
FIG. 5 is a view similar to that of FIG. 3 of another embodiment of a scent alarm device embodying various features of the present invention.

With reference to FIG. 5, there is illustrated an alternative embodiment, indicated 120, of the device of this invention. Several components of the device 120 are identical to those of the device 20 of FIGS. 1–4 and, accordingly, bear the same reference numerals. The device 120 differs from the device 20 in that it includes means, indicated 125, for intermittently depressing the canister spray nozzle 56 wherein the depressing means 125 includes a solenoid 122 having a plunger 124 which is moved between extended and retracted positions as the solenoid 122 is actuated and de-actuated for, respectively, moving the platform 66 from its raised position to a lowered position and for permitting the platform to return to its raised position. A cycling device 126 is wired in the circuit of device 120 in series with the solenoid 122.

Figure 6:
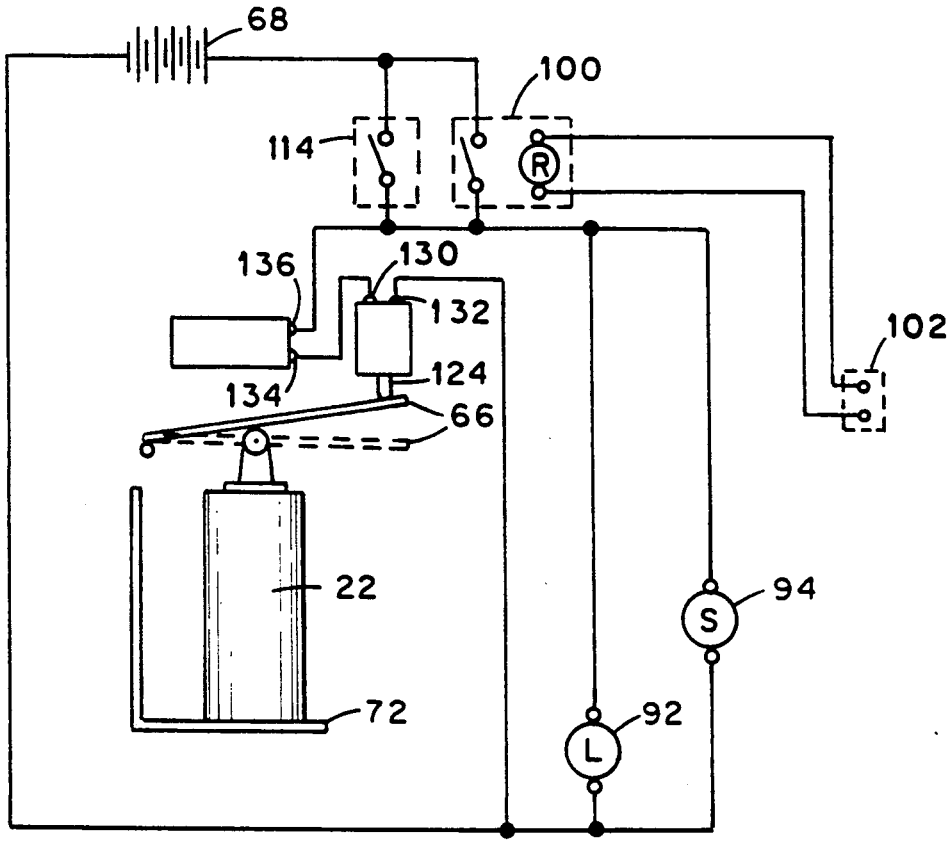
FIG. 6 is a wiring schematic of the FIG. 5 device.

The solenoid 122 is adapted to move its plunger 124 to an extended condition, and thus move the platform 66 to its lowered position, when a predetermined voltage is sensed across the solenoid contacts 130 and 132 (FIG. 6). The cycling device 126, on the other hand, has contacts 134 and 136 which are adapted to open when the platform 66 has been raised to a predetermined position, i.e., to the raised position of the platform 66. Consequently, the actuation of the solenoid 122 moves the platform 66 to its lowered position at which time the cycling device 126 deactuates the solenoid 122 and permits the platform 66 to return to its raised position. Upon return of the platform 66 to its raised position, the solenoid 122 is re-actuated. Of course, as the platform 66 is repeatedly moved between its raised and lowered positions, the canister spray nozzle 56 is repeatedly moved between depressed and extended conditions.

It will be understood that numerous modifications and substitutions can be had to the aforedescribed device 20 without departing from the spirit of the invention. For example, although each device 20 or 120 has been shown and described as including a power supply in the form of a battery 68 mounted within the housing 28, a device in accordance with the broader aspects of this invention may be appropriately wired to receive power from a standard electrical outlet. In addition, the device 20 or 120 may include a sound actuator appropriately wired within the circuit of the device for activating the device upon the sensing of a sound above a predetermined decibel level. Furthermore, automatic phonedialing means may be wired within the circuit of the device 20 or 120 and accessible by way of a phone jack mounted within a side of the housing of the device for automatically dialing a phone number, e.g., the phone number of a police or fire station, upon activation of the device 20 or 120. Accordingly, the aforedescribed embodiment is intended for the purpose of illustration and not as limitation.

We claim:

1. A scent alarm device comprising:

a spray canister of an odorant having a container containing an odorant under pressure and a depressible release valve having a nozzle which is movable relative to the container between depressed and extended positions for release of canister contents upon the depression of the release valve nozzle to its depressed position and which is biased by the pressurized contents toward its extended position;

means for intermittently depressing the release valve nozzle upon the occurrence of a predetermined event to intermittently release canister contents into the surrounding atmosphere, said means for intermittently depressing including a rotatable cam associated with the release valve for depressing the release valve nozzle in a cyclic fashion as the cam is rotated and a motor which is connected to the cam for rotating the cam as the motor is energized so that upon energizing of the motor, the release valve nozzle is moved relative to the container between its depressed and extended positions; and means interposed between the release valve nozzle and the motor for preventing the motor from being de-energized as long as the release valve nozzle is in its depressed position so that upon de-energization of the motor, the nozzle is not required to overcome rotational resistance of the motor in order to return to its extended positions.

2. A scent alarm device comprising:

a housing including a wall having a vent passage communicating between the housing interior and housing exterior;

a spray canister of an odorant having a container containing an odorant under pressure and a depressible release valve which is movable relative to the container between depressed and extended conditions for release of canister contents upon the depression of the release valve and which is biased by the pressurized contents toward its extended position;

means for supporting the spray canister within the housing so that upon depression of the release valve to its depressed condition, canister contents are released from the canister toward and through the vent passage; and means associated with the housing for intermittently depressing the release valve of the spray canister upon the occurrence of a predetermined event to intermittently release canister contents from the housing through the vent passage, said means for intermittently depressing the release valve includes a rotatable cam associated with the release valve for depressing the release valve in a cyclic fashion as the cam is rotated and an electric motor connected to the cam for rotating the cam upon the occurrence of a predetermined event so that as the motor is energized, the release valve is moved relative to the container between its depressed and extended positions; and means interposed between the release valve and the motor for preventing the motor from being de-energized as long as the release valve is in its depressed position so that upon de-energization of the motor, the nozzle is not required to overcome rotational resistance of the motor in order to return to its extended position.

3. The device as defined in claim 2 wherein the means for intermittently depressing the release valve includes a lever member having a portion which is hingedly connected at a fixed location within the housing and having another portion which is pivotally movable about the fixed location between two pivotal positions and means for repeatedly moving the lever between the two pivotal positions, and the release valve is operatively associated with the lever member so that as the lever member is repeatedly moved between the two pivotal positions, the release valve is depressed in a cyclic fashion.

4. The device as defined in claim 3 wherein the release valve includes a nozzle positioned atop the container for movement relative thereto between depressed and extended conditions, and the supporting means includes a support platform upon which the canister is positioned for supporting the canister container in a stationary relationship with respect to the housing and generally beneath the lever member so that the nozzle is in engagement with the lever member, and the device further includes means for adjusting the distance that the support platform is spaced beneath the lever member so that the canister positioned upon the platform with its nozzle in engagement with the lever member may possess a height within a relatively broad range of heights.

5. The device as defined in claim 4 wherein the support platform is mounted within the housing for movement toward and away from the lever member along a substantially linear path, and the device further includes means for releasably securing the support platform in a preselected position along the linear path.

6. The device as defined in claim 2 further including means operatively connected to the means for intermittently depressing the release valve for interfacing the means for intermittently depressing the release valve with an electrical circuit external to the device so that the means for intermittently depressing the release valve is energized upon the opening or closing of the electrical circuit.

7. The device as defined in claim 2 further including a sound device operatively connected to the means for intermittently depressing the release valve for generating an audible signal when the means for intermittently depressing the release valve is energized.

8. The device as defined in claim 7 further including a light for illuminating an area adjacent the housing when the means for intermittently depressing the release valve is energized.

9. The device as defined in claim 2 further including a light for illuminating an area adjacent the housing when the means for intermittently depressing the release valve is energized.

* * * * *